US005499897A

United States Patent [19]

Frei

[11] Patent Number: 5,499,897

[45] Date of Patent: Mar. 19, 1996

[54] ARRANGEMENT FOR MANUFACTURING BOOK BLOCKS FORMED OF ADHESIVELY BOUND PRINTED SHEETS

[75] Inventor: Christoph Frei, Frauenfeld, Switzerland

[73] Assignee: Grapha-Holding AG, Hergiswil, Switzerland

[21] Appl. No.: 301,173

[22] Filed: Sep. 6, 1994

[30] Foreign Application Priority Data

Sep. 24, 1993 [CH] Switzerland ..... 02893/93

[51] Int. Cl.[6] ..... B42C 11/00

[52] U.S. Cl. ..... 412/18; 412/19

[58] Field of Search ..... 412/4, 1, 9, 18, 412/19, 24, 25, 33

[56] References Cited

U.S. PATENT DOCUMENTS 5,232,324 8/1993 Graushar ..... 412/18 X
5,318,398 6/1994 Kojima ..... 412/18
5,413,447 5/1995 Rathent ..... 412/4 X

FOREIGN PATENT DOCUMENTS 408857 3/1966 Switzerland .
516408 12/1971 Switzerland .

*Primary Examiner*—Willmon Fridie, Jr.
*Attorney, Agent, or Firm*—Friedrich Kueffner

[57] ABSTRACT

An arrangement for manufacturing book blocks formed of printed sheets which are bound by an adhesive includes a spiral guide wall for transferring the gathered printed sheets which are placed one on top of the other in stacks from an essentially horizontal position into a vertical position. The arrangement further includes a support element which projects at approximately a right angle from a lower edge of the guide wall for guiding the stacks at the rear folded edges of the printed sheets and a guide duct formed by a guide rail which is adjustable in accordance with the height of the stacks. A filling element is arranged between the support element and the guide rail, wherein the filling element extends at least closely adjacent to or partially into the conveying duct, and wherein the filling element can be placed so as to rest against the support element.

7 Claims, 1 Drawing Sheet

ARRANGEMENT FOR MANUFACTURING BOOK BLOCKS FORMED OF ADHESIVELY BOUND PRINTED SHEETS

BACKGROUND OF THE INVENTION

1. Field of the Invention

The present invention relates to an arrangement for manufacturing book blocks formed of printed sheets which are bound by an adhesive. The arrangement includes a spiral guide wall for transferring the gathered printed sheets which are placed one on top of the other in stacks from an essentially horizontal position into a vertical position. The arrangement further includes a support element which projects at approximately a right angle from a lower edge of the guide wall for guiding the stacks at the rear folded edges of the printed sheets and a guide duct formed by a guide rail which is adjustable in accordance with the height of the stacks.

2. Description of the Related Art

As is well known, the various printed sheets are gathered into loose stacks in a gathering machine composed of a plurality of feeders or loaders arranged in a row. The printed sheets are usually placed by the feeders or loaders one on top of the other in the collecting duct of the gathering machine with the rear folded edges of the printed sheets forming the back of the book block to be produced being first, and the printed sheets are collected in the correct sequence into a complete loose book block.

For this purpose, the collecting duct of the gathering machine may have a slightly inclined flat position.

The collecting duct of the gathering machine is followed by a conveying duct which is the subject of the present invention. The same conveying device with drive members is provided for the conveying duct as for the collecting duct.

In the conveying duct, also called transfer duct, the stacks are transferred from an approximately horizontal position into a vertical position by being guided along a spiral guide wall and a support element which projects from the lower edge of the guide wall and guides the stacks at the rear folded edges of the printed sheets.

In order to prevent the stack from falling over, a guide rail is provided on the side of the stack located opposite the spiral guide wall. The guide rail is constructed so as to be adjustable in accordance with the height of the stack.

In the known arrangement, since the conveying duct, and particularly the support element, have a twisted shape and since the guide rail is adjustable, it is impossible to prevent the formation of a slot-like gap between the support element and the guide rail over the entire length of the conveying duct. This situation may negatively affect the conveyance of the stacks.

For example, the printed sheets sliding along the guide rail may be clamped with the rear folded edges into the slot-like opening and may be held back which, among other problems, would interrupt the manufacturing process.

This effect is reinforced by the pressure applied on the book block to hold the book block together.

The formation of recesses acting in the manner of a wedge cannot be prevented by dividing the guide rail into shorter sections along the support element.

SUMMARY OF THE INVENTION

Therefore, it is the primary object of the present invention to provide an arrangement of the above-described type in which it is ensured that the distance between the guide surface and the guide rail is adjustable and the stacks are conveyed in the conveying duct essentially without problems.

In accordance with the present invention, a filling element is arranged between the support element and the guide rail, wherein the filling element extends at least closely adjacent to or partially into the conveying duct, and wherein the filling element can be placed so as to rest against the support element.

As a result of the configuration according to the present invention, the tendency of the printed sheets being clamped at the longitudinal guide edge between support element and guide rail is essentially eliminated.

The filling element may be a brush whose bristles are pretensioned in lateral direction. This results in an optimum connection between the filling element and the support element.

In accordance with a particularly advantageous feature, the filling element is a brush whose bristles extend approximately perpendicularly relative to the conveying duct and almost entirely through the opening between the guide rail and the support element, wherein the tips of the bristles end approximately in alignment with the guide rail which forms a duct wall.

In accordance with another feature, the tips of the bristles may extend into the free conveying duct. This causes the leading edge of the passing stack of printed sheets to be displaced into a position in which they are deflected toward the conveying direction, so that the bristles apply an advantageous counterpressure against the collected printed sheets.

A brush is particularly useful as the filling element if the bristles can be biased in the opening against the support element, so that the formation of a clamping location is prevented.

In order to be able to change the position of the bristles and/or the biasing pressure of the bristles against the support element, a shaft which receives the bristles of the brush at one end thereof is adjustable.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
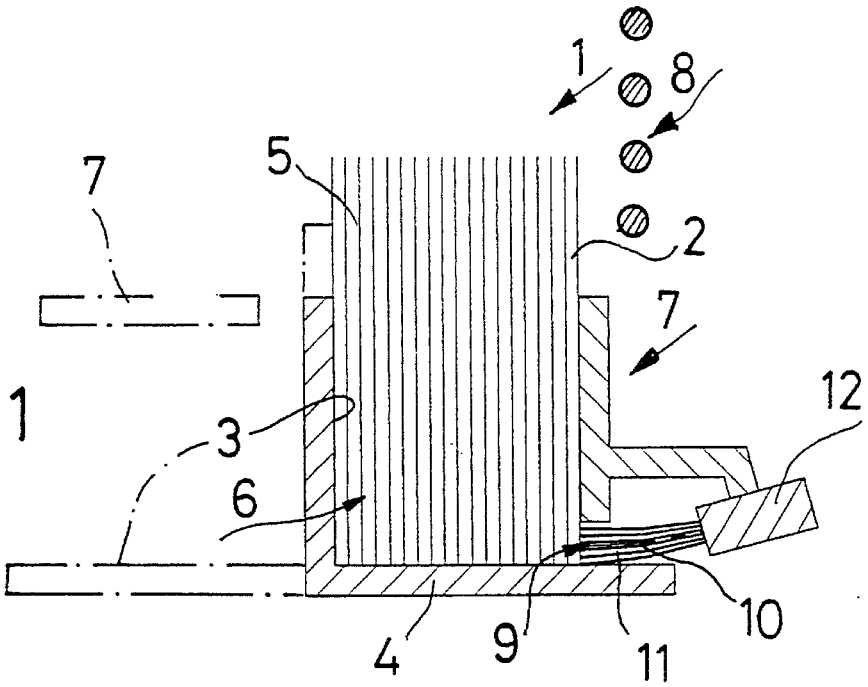
FIG. 1 is a partial cross-sectional view of the conveying duct of the arrangement according to the present invention.

FIG. 1 of the drawing shows an arrangement 1 for the manufacture of book blocks formed of adhesively bound printed sheets. The arrangement 1 includes a spiral guide wall 3 and a support element 4 which projects approximately at a right angle from the lower edge of the guide wall 3. The guide wall 3 and the support element 4 together form the guide means of a conveying duct 6. Stacks 5 of printed sheets 2 which are collected and placed one on top of the other are transported in a collecting duct of a gathering machine, not shown, to a book block feeder or loader of an adhesive binder through the conveying duct 6 along the spiral guide wall 3 and, as a result, are moved from a horizontal position into a vertical position, wherein the printed sheets 2 are placed with their rear folded edges onto the support element 4 and form the book block back which is to be finished later.

The support element 4 forms a slideway. In larger embodiments, the support element 4 may also be a roller surface or a driven surface.

The dashed-dot lines shown in FIG. 1 indicate the horizontal or slightly inclined initial position of the conveying duct 6 in the area of the gathering machine. The spiral of the conveying duct 6 reaches about 90° by the end of the conveying duct 6.

Following the gathering machine the conveying duct 6 has a guide rail 7 which extends approximately parallel to the guide wall 3. The distance between the guide wall 3 and the guide rail 7 is adjustable.

Because of the rear folded edges of the printed sheets 2, the stacks 5 arriving from the gathering machine have a cross-section which is expanded in the shape of a mushroom at the support element 4. This non-uniform cross-sectional shape of the stacks results in special requirements to be made with respect to a problem-free operation in the conveying duct 6. The friction between the individual printed sheets 2 is greater than the friction between the outer printed sheets 2 and the guide wall 3 and the guide rail 7 of the conveying duct 6. This requirement can be met or controlled by the force by which the guide rail 7 presses against the printed sheets 2. If the pressing force is too high, the rear folded edges of the printed sheets 2 produce a higher pressure at the guide wall 3 and the guide rail 7. This increased pressure has resulted in processing problems in the prior art arrangement. Accordingly, the guide rail 7 causes the stack 5 to be compacted to a certain extent and, as mentioned, the guide rail 7 can be adjusted in accordance with the height of the stack 5 formed of printed sheets 2. The guide rail 7 is connected to a stationary frame or the like. The guide rail 7 is adjustable, for example, telescopically or by means of threaded spindles.

The guide rail 7 may be supplemented by a grate-like lateral guide means 8 which is arranged parallel to and adjacent the guide rail 7. The lateral guide means 8 prevents the freely projecting portion of the stack 5 from tilting from the approximately vertical position to the side. The lateral guide means 8 formed by individual rods may be adjustable independently or in connection with the guide rail 7.

A slot-like opening 9 which extends over the length of the guide rail 7 exists or is provided between the guide rail 7 and the support element 4 because of the fact that the guide rail 7 is adjustable with respect to the height of the stack 5. A filling element 10 extends from outside of the conveying duct 6 into the opening 9 either at least close to the conveying duct 6 or at least partially into the conveying duct 6. As a result, the opening 9 is closed by the filling element 10, so that the printed sheet 2 of a stack 5 sliding along the guide rail 7 cannot enter the opening 9 and be clamped in the opening 9.

The filling element 10 may be a brush whose bristles 11 are placed against or tensioned against the support element 4, so that a situation is created in which the opening 9 is closed off relative to the conveying duct 6. The ends of the bristles 11 simultaneously form a conveying duct wall which supplements the guide rail 7.

Figure 2:
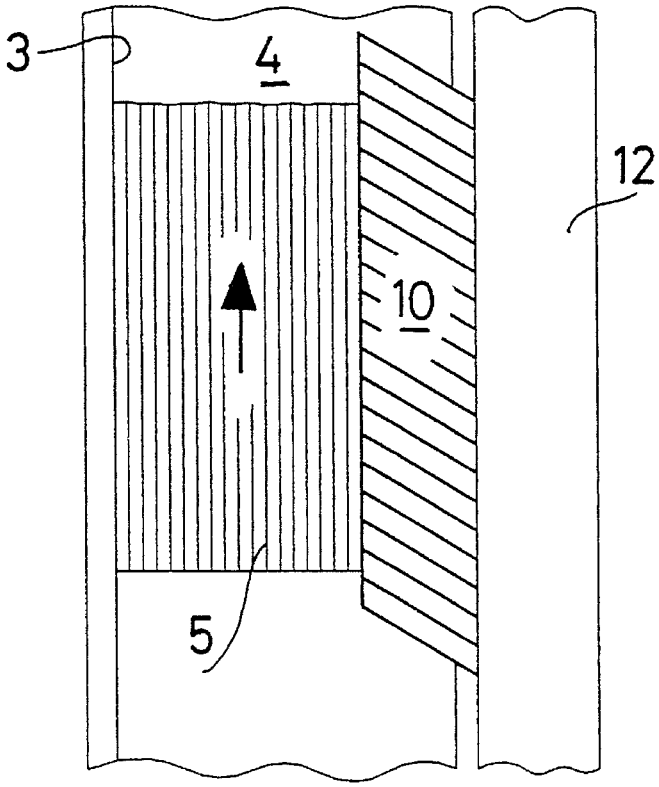
FIG. 2 is a longitudinal sectional view of the conveying duct taken along line II—II of FIG. 1.

If the bristles 11 project through the opening 9 between the guide rail 7 and the support element 4 and partially into the conveying duct 6, the leading edge of a stack 5 passing through the conveying duct 6 deflects the bristles 11 in conveying direction, as shown in FIG. 2. This makes it possible to reduce the scratching effect of the bristle tips on the outermost printed sheet 2. The initial tension of the bristles 11 against the support element 4 is maintained.

At the ends remote from the conveying duct 6, the bristles 11 of the filling element 10 in the form of a brush are fastened or anchored in a shaft 12. This shaft 12 can be connected to the guide rail 7 in order to be adjustable. The shaft 12 also makes it possible to adjust the tension of the bristles 11 relative to the support element 4.

The invention is not limited by the embodiments described above which are presented as examples only but can be modified in various ways within the scope of protection defined by the appended patent claims.

I claim:

1. An arrangement for manufacturing book blocks formed of stacks of adhesively bound printed sheets, the printed sheets having rear folded edges, the arrangement comprising a guide duct comprising a wound guide wall for moving each stack from an approximately horizontal position into a vertical position, the guide wall having a lower edge, a support element connected to and projecting approximately at a right angle from the lower edge of the guide wall for guiding the stack at the rear folded edges of the printed sheets, and a guide rail, means for adjusting the guide rail in accordance with a height of the stack, an opening being defined between the support element and the guide rail, further comprising a filling element mounted so as to extend into the opening and to contact the support element.

2. The arrangement according to claim 1, wherein the opening has an end at the conveying duct, and wherein the filling element extends into the opening at least closely adjacent to the end at the conveying duct.

3. The arrangement according to claim 1, wherein the filling element extends partially into the conveying duct.

4. The arrangement according to claim 1, further comprising means for biasing the filling element with initial tension against the support element.

5. The arrangement according to claim 1, wherein the filling element comprises a brush with a plurality of bristles, wherein the bristles extend approximately perpendicularly to the conveying duct and at least partially into the opening.

6. The arrangement according to claim 5, comprising means for biasing the bristles of the brush with initial tension against the support element.

7. The arrangement according to claim 6, wherein the brush comprises an adjustable shaft, the bristles being attached at one end thereof to the shaft.

* * * * *